US005088461A

United States Patent [19]

Ohashi et al.

[11] Patent Number: 5,088,461

[45] Date of Patent: Feb. 18, 1992

[54] THROTTLE VALVE CONTROL SYSTEM AND THE METHOD THEREFOR

[75] Inventors: Shinji Ohashi; Norifumi Isaji, both of Zushi; Hajime Satoh, Yokohama, all of Japan

[73] Assignee: Nissan Motor Co., Ltd., Yokohama, Japan

[21] Appl. No.: 676,575

[22] Filed: Mar. 28, 1991

[30] Foreign Application Priority Data

Apr. 9, 1990 [JP] Japan ..... 2-93535

[51] Int. Cl.[5] ..... F02D 7/00

[52] U.S. Cl. ..... 123/399; 123/353

[58] Field of Search ..... 123/399, 361, 340, 492, 123/352, 353; 180/176

[56] References Cited

U.S. PATENT DOCUMENTS 3,722,614 3/1973 Sakakibara et al. ..... 123/353
4,245,599 1/1981 Des Lauriers ..... 123/353
4,297,978 11/1981 Matsui ..... 123/353
4,359,124 11/1982 Ninoyu et al. ..... 180/176
4,389,990 6/1983 Murray ..... 123/353
4,953,530 9/1990 Manaka et al. ..... 123/399
4,969,431 11/1990 Wataya ..... 123/399

*Primary Examiner*—Raymond A. Nelli
*Attorney, Agent, or Firm*—Foley & Lardner

[57] ABSTRACT

In the throttle valve control system for controlling a throttle valve by an actuator driven on the basis of PWM command signals generated according to accel pedal stroke and feed-backed throttle sensor signals, the throttle sensor signal obtained when the throttle valve is full closed is stored; the throttle sensor signal obtained when a full-close PWM command signal is applied to the actuator is detected; the full-close PWM command signal is corrected so that the stored throttle sensor signal matches the detected throttle sensor signal; and PWM command signals are generated on the basis of the corrected full-close PWM command signal. Therefore, it is possible to obtain a full-close PWM command signal whose pulse width accurately matches the actual throttle valve full-close position, irrespective of error or offset due to dispersion of the throttle sensor characteristic or A–D conversion characteristic of the control system.

6 Claims, 7 Drawing Sheets

THROTTLE VALVE CONTROL SYSTEM AND THE METHOD THEREFOR

BACKGROUND OF THE INVENTION

The present invention relates to a throttle valve control system and the control method therefor, and more specifically to a throttle valve control system for driving a throttle valve actuator on the basis of PWM command signals generated according to accel pedal stroke and feed-backed throttle sensor signals.

DESCRIPTION OF THE PRIOR ART

To accurately control vehicle engine speed, it is indispensable that a throttle valve is actuated open at an accurate opening rate. To actuate a throttle valve actuator at higher precision, conventionally there has been proposed such a method that the depression stroke of an accel pedal is detected in the form of PWM (pulse width modulation) signals and then the PWM signals are converted into analog signals before feed-back controlling the throttle valve. In this method of controlling the throttle valve, the PWM signals are converted into analog signals in accordance with predetermined conversion characteristics to actuate the throttle valve actuator; and on the other hand, throttle valve opening rate is detected by a throttle sensor for generating an opening rate signal in accordance with predetermined sensor characteristics.

FIG. 1A shows an example of signal conversion characteristics between the PWM signal represented by on-duty factor (%) and the analog signal output voltage (V), in which a solid line a represents an ideal conversion characteristic determined from design standpoint and an area A enclosed by four points of DL1 DL2, DH2 and DH1 is an actual conversion characteristic area obtained under consideration of manufacturing errors or element dispersion. On the other hand, FIG. 1B shows an example of sensor characteristics between the throttle valve opening rate ($\theta$:degress) and the throttle sensor signal output voltage (V), in which a solid line b represents an ideal sensor characteristic determined from design standpoint and an area B enclosed by four points of CL1, CL2, OP2 and OP1 is an actual sensor characteristic area obtained under consideration of manufacturing errors or element dispersion.

Accordingly, in FIG. 1A, in spite of the fact that the signal conversion characteristic is so designed as to obtain an analog signal output voltage Va (V) (at which the throttle valve is full closed) when the PWM on-duty factor is $d_1$ (%) in accordance with the designed conversion characteristic a, since the conversion characteristic between the PWM on-duty factor and the analog signal output (V) is offset from the designed characteristic a to a dashed line $A_1$, for instance extending between two points DL2 and DH2, there exists a problem in that a throttle actuating motor is kept driven by the analog signal output $V_A$ to further close the throttle valve in response to the PWM signal with an on-duty factor $d_1$ after the throttle valve has been full closed, so that the motor and the throttle valve are damaged or the life time thereof is reduced.

Further, in FIG. 1B, in spite of the fact that the sensor characteristic is so designed as to output a throttle sensor signal output Vb (V) (at which the throttle valve is full closed) when the throttle valve opening rate is $d_2$ (degrees) in accordance with the designed sensor characteristic b, since the sensor characteristic between the throttle valve opening rate $\theta$ and the throttle sensor signal output is offset from the designed characteristic b to the dashed line B1, for instance extending between two points CL2 and OP2, there exists a problem in that the throttle sensor signal output Vb (V) (at which the throttle valve is full closed) is generated at the throttle valve opening rate $d_3$, so that it is impossible to generate a throttle command signal to further close the throttle valve below the opening rate $d_3$.

SUMMARY OF THE INVENTION

With these problems in mind, therefore, it is the primary object of the present invention to provide a throttle valve control system and the method therefor of accurately controlling the throttle valve on the basis of throttle valve opening command signals obtained in accordance with the actual throttle valve opening rate.

To achieve the above-mentioned object, the throttle valve control system for controlling a throttle valve (7) by an actuator (5) driven on the basis of PWM command signals (13) generated according to stroke of an accel pedal (1) and throttle signals (10) feed-backed by a throttle sensor (6) according to the present invention, comprises: (a) throttle opening-rate command signal generator (3) including: (1) storing means (31) for storing a signal level of the throttle sensor signal obtained when the throttle valve is full closed; (2) detecting means (32) for detecting a signal level of the throttle sensor signal obtained when a full-close PWM command signal is applied to the actuator; (3) correcting means (33) responsive to said storing means and said detecting means, for correcting the full-close PWM command signal so that the signal level of the throttle sensor signal stored in said storing means matches that detected by said detecting means; and (4) PWM command generating means (34) responsive to said correcting means, for generating PWM command signals on the basis of the corrected full-close PWM command signal; and (b) a throttle controller (4) responsive to said opening-rate command signal generator and the throttle sensor, for feed-back controlling throttle valve opening rate on the basis of the generated PWM command signals and the throttle sensor signals. The throttle controller comprises: (a) a convertor (41) for converting the PWM command signal into an analog command signal; (b) a differential amplifier (42) responsive to said convertor and the throttle sensor, for generating a difference signal in voltage level between the analog command signal and the throttle sensor signal; (c) a calculator (43) responsive to said differential amplifier, for calculating an actuator drive signal; and (d) an actuator driver (44) responsive to said calculator, for driving the actuator to actuate the throttle valve.

Further, the method of controlling a throttle valve (7) by an actuator (5) driven in response to PWM command signals (13) generated according to stroke of an accel pedal (1), comprising the steps of: (a) detecting and storing an accel sensor signal obtained when the accel pedal is released; (b) detecting and storing a throttle sensor signal obtained when the throttle valve is full closed; (c) when determining that the accel pedal is released but the throttle valve is not full closed on the basis of the stored accel and throttle sensor signals, decreasing pulse width of the PWM command signal until the throttle is full closed; (d) when determining that the throttle valve is full closed, checking whether the actuator is driven in throttle-close direction or -open direction; (e) when the actuator is driven in throttle close direction, increasing the PWM pulse width in a throttle-open direction; (f) when the actuator is driven in throttle open direction, decreasing the PWM pulse width in a throttle-close direction; (g) repeating the above steps (e) and (f) a predetermined number of times; (h) storing the PWM pulse width as a full-close PWM command signal; and (i) controlling the throttle valve on the basis of the stored full-close PWM command signal and in response to the generated PWM command signals.

In the throttle valve control system and the method according to the present invention, the throttle sensor signal obtained when the throttle valve is full closed is previously stored; the current throttle sensor signal obtained when a full-close PWM command signal is applied to the actuator is detected periodically; and the pulse width of the full-close PWM command signal is corrected so that the stored throttle sensor signal and the detected throttle sensor signal matches with each other. Therefore, it is possible to match the PWM throttle opening-rate command signal with the throttle sensor signal, irrespective of the presence of offset from the designed valve in the conversion characteristic between the PWM signals and the converted analog signals and the output characteristic between the throttle opening rates and the throttle sensor signals, thus improving the throttle valve control precision according to the accel pedal stroke.

DETAILED DESCRIPTION OF THE PREFERRED EMBODIMENTS

The throttle valve control system according to the present invention will be described hereinbelow with reference to the attached drawings.

Figure 2:
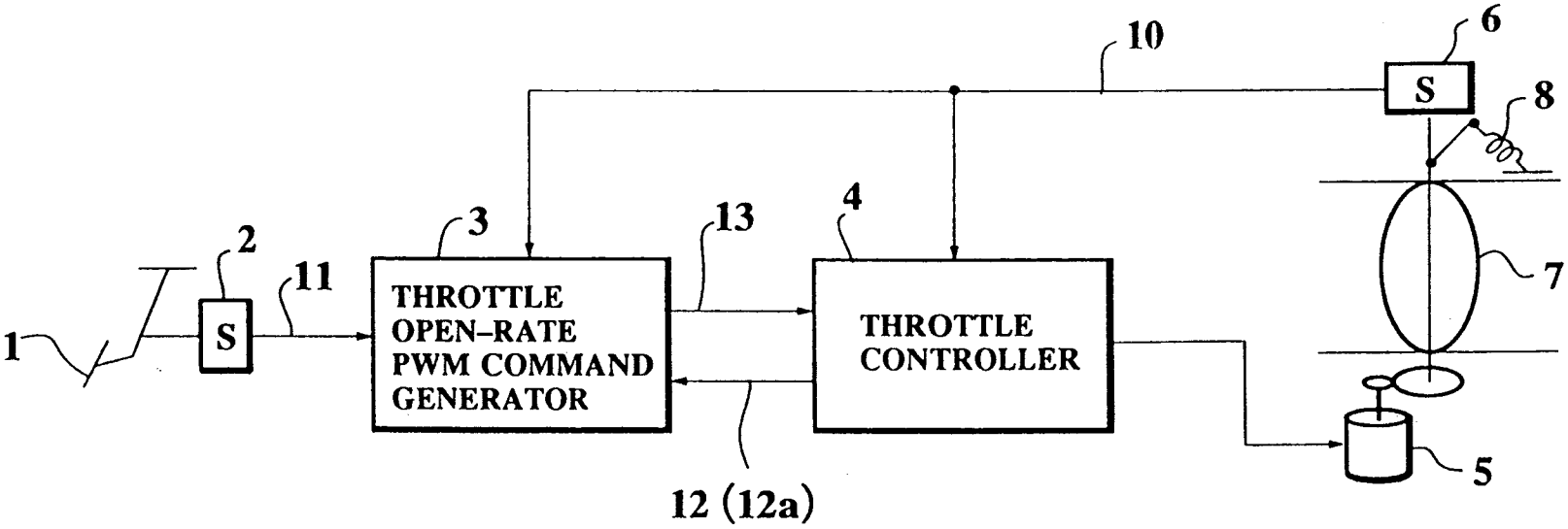
FIG. 2 is a schematic block diagram showing the throttle valve control system according to the present invention.

FIG. 2 is a block diagram showing an embodiment thereof. In the drawing the control system comprises an accel pedal 1, an accel sensor 2, a throttle opening rate PWM command generator 3, a throttle controller 4, a motor 5, a throttle sensor 6, a throttle valve 7, a throttle return spring 8, etc. The depression stoke of the accel pedal 1 depressed by a driver is detected by the accel sensor 2, and given to the throttle opening rate PWM command generator 3 as an accel sensor signal 11. The throttle valve 7 is actuated open by the motor 5 and returned to the full-close position by the return spring 8. The opening rate of the throttle valve 7 is detected by the throttle sensor 6, and given to the PWM command generator 3 and the throttle controller 4 as a throttle sensor signal 10. The throttle opening rate PWM command generator 3 calculates a throttle opening rate PWM command on the basis of the accel sensor signal 11, the throttle sensor signal 10, and a motor direction monitor signal 12 obtained by the analog throttle controller 4, generates a PWM (pulse width modulation) command signal 13 whose pulse width varies according to the calculated result, and outputs the PWM command signal 13 to the throttle controller 4.

Figure 2A:
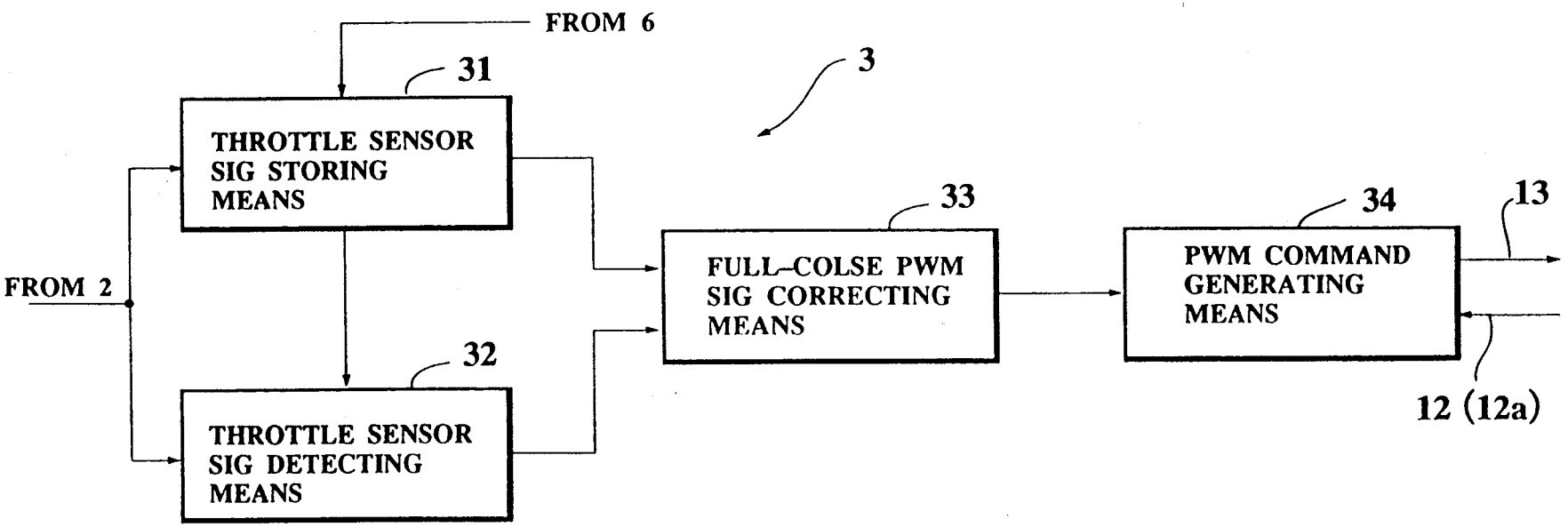
FIG. 2A is a schematic block diagram showing the throttle opening-rate PWM command generator shown in FIG. 2.

FIG. 2A shows a block diagram of the throttle opening-rate PWM command generator 3, which comprises throttle sensor signal storing means 31 for storing the signal level of the throttle sensor signal obtained when the throttle valve is full closed, throttle sensor signal detecting means 32 for detecting a signal level of the throttle sensor signal obtained when a PWM command signal to close the throttle valve to its full-close position is applied to the motor 5, full-close PWM signal correcting means 33 for correcting the full-close PWM command signal so that the signal level of the throttle sensor signal stored in the storing means 31 matches that detected by the detecting means 32, and PWM command generating means 34 for generating PWM command signals 13 to open the throttle valve according to the stroke of the accel pedal 1 on the basis of the corrected full-close PWM command signal.

The throttle controller 4 converts the digital PWM command signal 13 outputted by the throttle opening rate PWM command generator 3 to an analog output signal corresponding thereto, and gives it to the motor 5 as a motor driving signal 14.

Figure 2B:
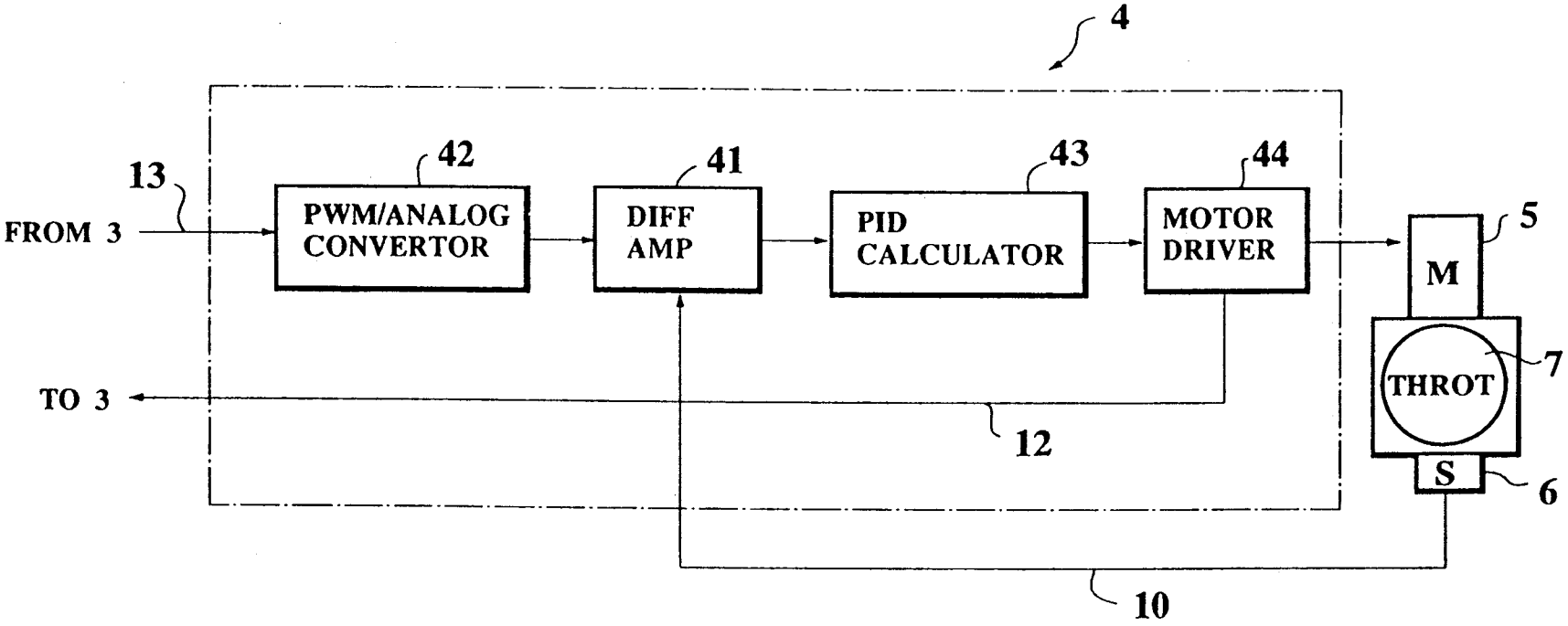
FIG. 2B is a schematic block diagram showing the throttle controller shown in FIG. 2.
Figure 3A:
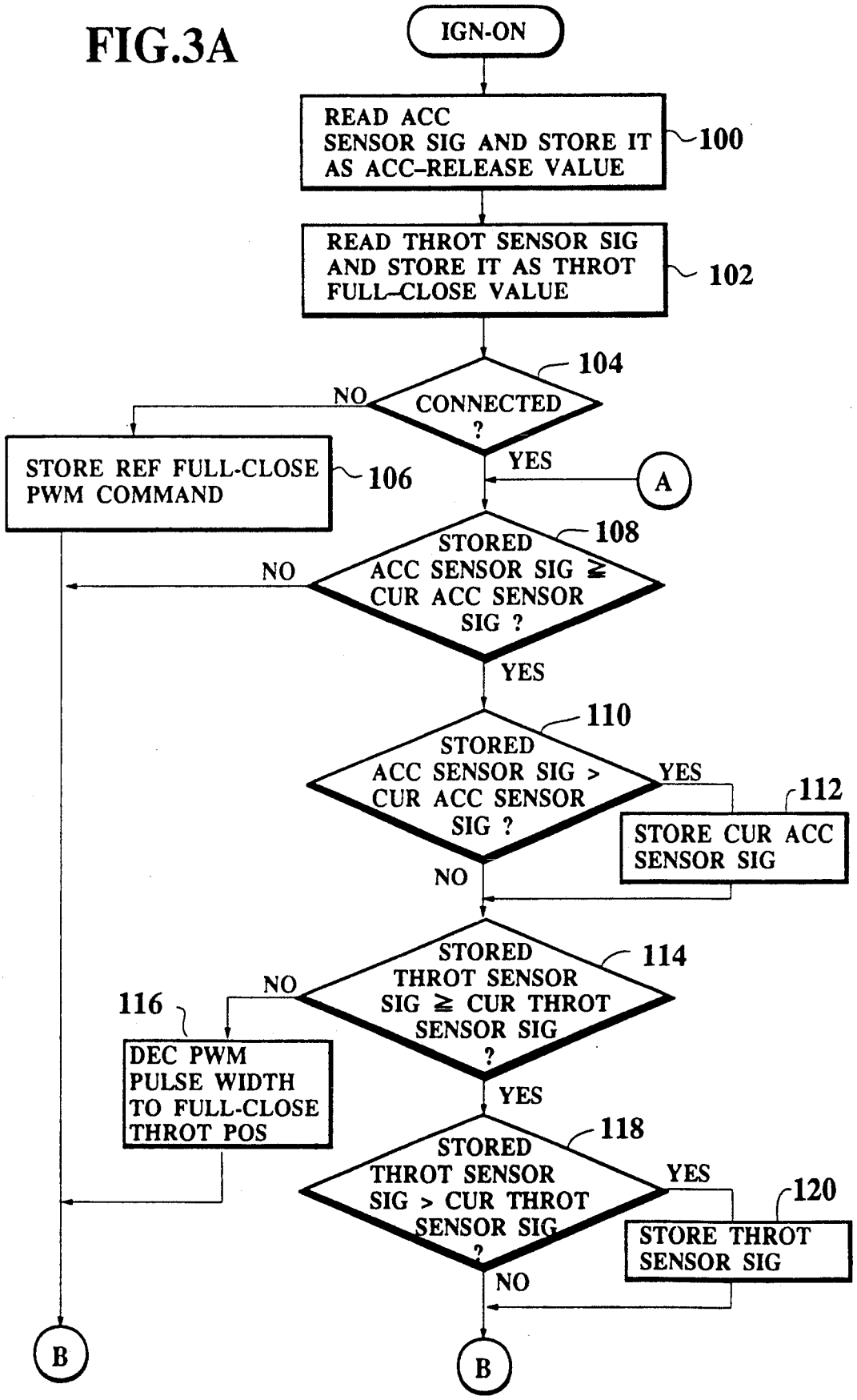
FIGS. 3A and 3B illustrate a flowchart for assistance in explaining the operation of the throttle opening-rate PWM command generator according to the present invention shown in FIG. 2A.
Figure 3B:
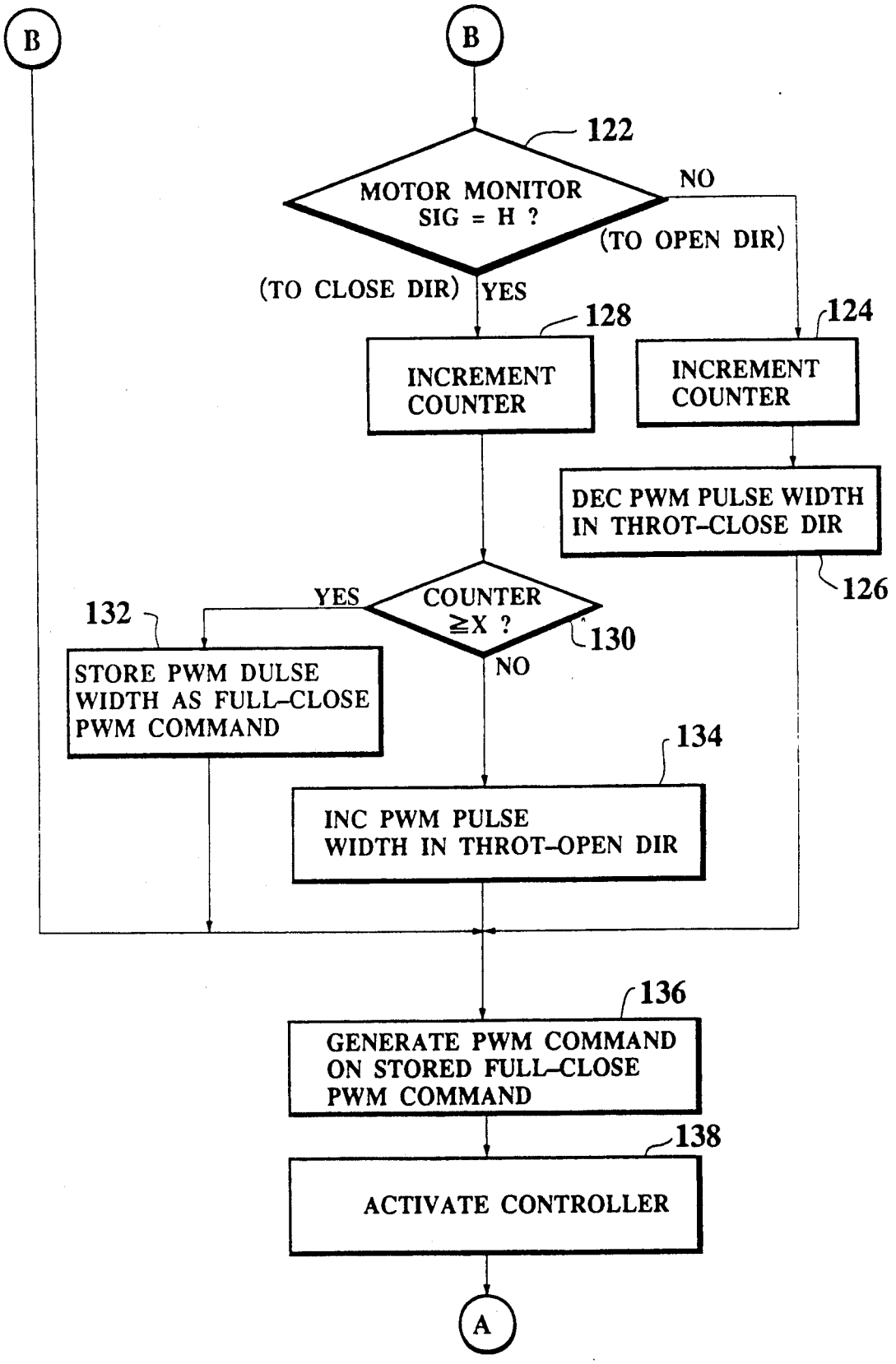

FIG. 2B shows the throttle controller 4 in further detail. That is, the throttle controller 4 comprises a PWM/ANALOG convertor 41 for converting the PWM command signal 13 given by the throttle opening rate PWM command generator 3 into an analog signal corresponding thereto, a differential amplifier 42 for generating a differential signal between the (actual) throttle sensor signal 10 given by the throttle sensor 6 and the analog signal given by the PWM/ANALOG convertor 41, a PID (proportional integrated and derivative) calculator 43 for calculating the motor driving signal 14 in accordance with PID control, and a motor driver 44 for generating a motor driving output signal on the basis of the PID calculated results.

In the PID control, the manipulated variable signal applied to an object (i.e. throttle valve) to be controlled is obtained by adding values proportional to the current value, integrated value and derived (differential) value, respectively of the actuating signal. Further, without being limited to the PID control, it is of course possible to control the throttle valve in accordance with P (proportional) control, I (integrated) control, PI (proportional integrated) control, or PD (proportional derivative) control, respectively.

Further, the motor direction monitor signal 12 is transmitted from the motor driver 44 to the throttle opening rate PWM command generator 3. This motor direction monitor signal 12 is at H-level when the throttle valved is being closed by the return spring 8 but at L-level when being opened by the motor 5.

With reference to the flowchart shown in FIG. 4, the operation procedure for generating a PWM command signal 13 executed by the throttle opening rate PWM command generator 3 in accordance with a control program will be described hereinbelow.

When an ignition switch (not shown) is turned on, control starts. Control reads an accel sensor signal 11 and stores it as an accel-release sensor signal level (in step 100). Control reads a throttle sensor signal 10 and stores it as a throttle full-close position sensor signal level (in step 102). Thereafter, control checks whether a transmission line 12*a* (shown in FIG. 2) extending from the throttle controller 4 to the throttle opening rate PWM command generator 11 is connected or not on the basis of the motor direction monitor signal 12 (in step 104). That is, since the monitor signal 12 is at H-level when the throttle valve is being closed, if an H-level monitor signal 12 is given from the controller 4 to the generator 3, the transmission line is determined to be connected. However, if an L-level monitor signal 12 is given, the transmission is determined to be disconnected, because the accel pedal 1 is not depressed and therefore the motor 5 is not yet being driven.

Figure 1A:
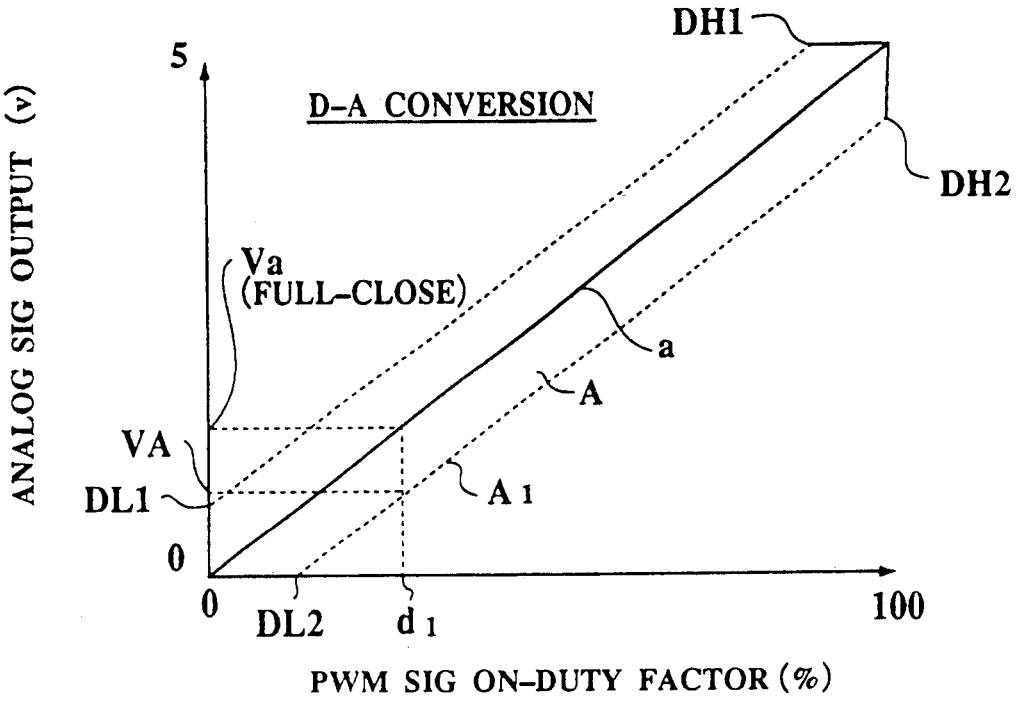
FIG. 1A is a graphical representation showing the D-A conversion characteristic between the PWM on-duty factor (%) and the analog signal output voltage (V) according to accel pedal depression stroke, for assistance in explaining problems involved in the prior-art throttle valve control apparatus.
Figure 1B:
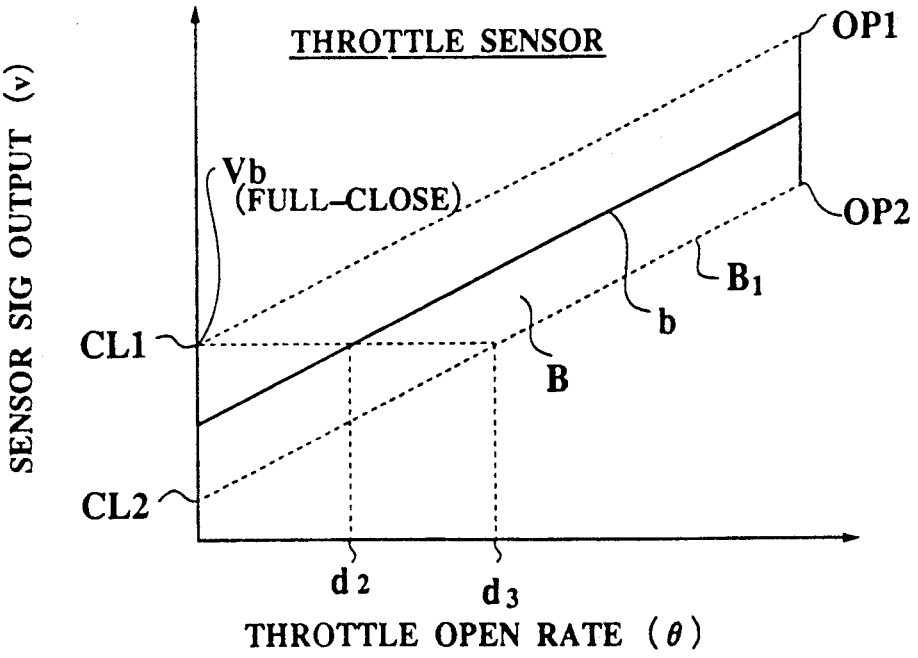
FIG. 1B is a graphical representation showing the throttle sensor characteristic between the throttle valve opening rate ($\theta$) and the throttle sensor signal output voltage (V), for assistance in explaining problems involved in the prior-art throttle valve control apparatus.

If determined to be disconnected (NO) in step 104, control stores a previously determined reference full-close PWM command signal with an on-duty factor $d_1$ (as shown in FIG. 1A), for instance (in step 106) and generates the PWM command signals on the basis of the stored reference (basic) full-close PWM command signal (in step 136). Therefore, the throttle controller 14 is activated in accordance with this PWM command signals 13 thus obtained (in step 138).

On the other hand, if determined to be connected (YES) in step 104, control proceeds to the following steps from 108 to 134, which are the main feature of the present invention. Control first checks the current accel sensor signal 11. That is, the accel-release sensor signal stored in step 100 is compared in voltage level with the current accel sensor signal detected by the accel sensor 2 (in step 108). If the current accel sensor signal is higher than the stored accel-release sensor signal (NO) in step 108, control determines that the accel pedal 1 is depressed, and proceeds to step 136 to generates a PWM command signal on the basis of the stored full-close PWM command.

On the other hand, if the current detected accel sensor signal is equal to or lower than the accel-release sensor signal (YES) in step 108, control determined the accel pedal 1 is not yet depressed, and proceeds to the step 110.

If the current accel sensor signal is lower than the stored accel sensor signal (YES) in step 110, control stores the current smaller accel sensor signal as a new accel-release sensor signal (in step 112), and proceeds to step 114 to check the current throttle sensor signal 10. That is, the throttle sensor signal stored in step 102 is compared in voltage level with the current throttle sensor signal detected by the throttle sensor 6 (in step 114). If the current throttle sensor signal is higher than the stored throttle sensor signal (NO) in step 114, control determines that the throttle valve 7 is not yet full closed, and proceeds to the succeeding step to decrease the pulse width of the PWM command 13 until the throttle valve is full closed (in step 116) and further to step 136 to generates a PWM command signal on the basis of the stored full-close PWM command.

On the other hand, if the current throttle sensor signal is equal to or smaller than the stored throttle sensor signal (YES) in step 114, control determines that the throttle valve is full closed, and proceeds to the step 118. If the current throttle sensor signal is lower than the stored throttle sensor signal (YES) in step 118, control shores the current lower throttle sensor signal as a new full-close throttle sensor signal (in step 120), and proceeds to step 122 to check whether the motor direction monitor signal 12 is at H- or L-level (in step 122). If at H-level (NO) in step 122, control determines that the motor 5 is driven in the direction that the throttle valve is being closed or the motor is not driven and therefore the throttle valve is returned by the return spring 8, and proceeds to the succeeding step to increment (count up) a counter (in step 124). If at L-level (YES) in step 122, control determines that the motor 5 is driven in the direction that the throttle is being opened, and proceeds to the succeeding step to also increment (count up) the counter (in step 128).

After counter increment (in step 124), control decreases the pulse width of the PWM command signal 13 in the throttle valve close direction (in step 126). After counter increment (in step 128), control checks whether the counter valve is equal to or more than a predetermined valve X (in step 130). If equal to or more than X, control stores the PWM pulse width as a full-close PWM command (in step 132). If less than X, control increases the PWM pulse width in the throttle valve open direction (in step 134). After the above-mentioned steps 126, 132 and 134, control outputs a PWM command on the basis of the stored basic full-close PWM signal to activate the controller 4. Further, the above-mentioned steps from 108 to 138 are repeated by the predetermined number (X) of times, so that the full-close PWM command signal 13 approaches stepwise to the actual full-close PWM command signal 13 by repeatedly increasing or decreasing the PWM pulse width in the throttle-open or throttle-close direction.

Figure 4:
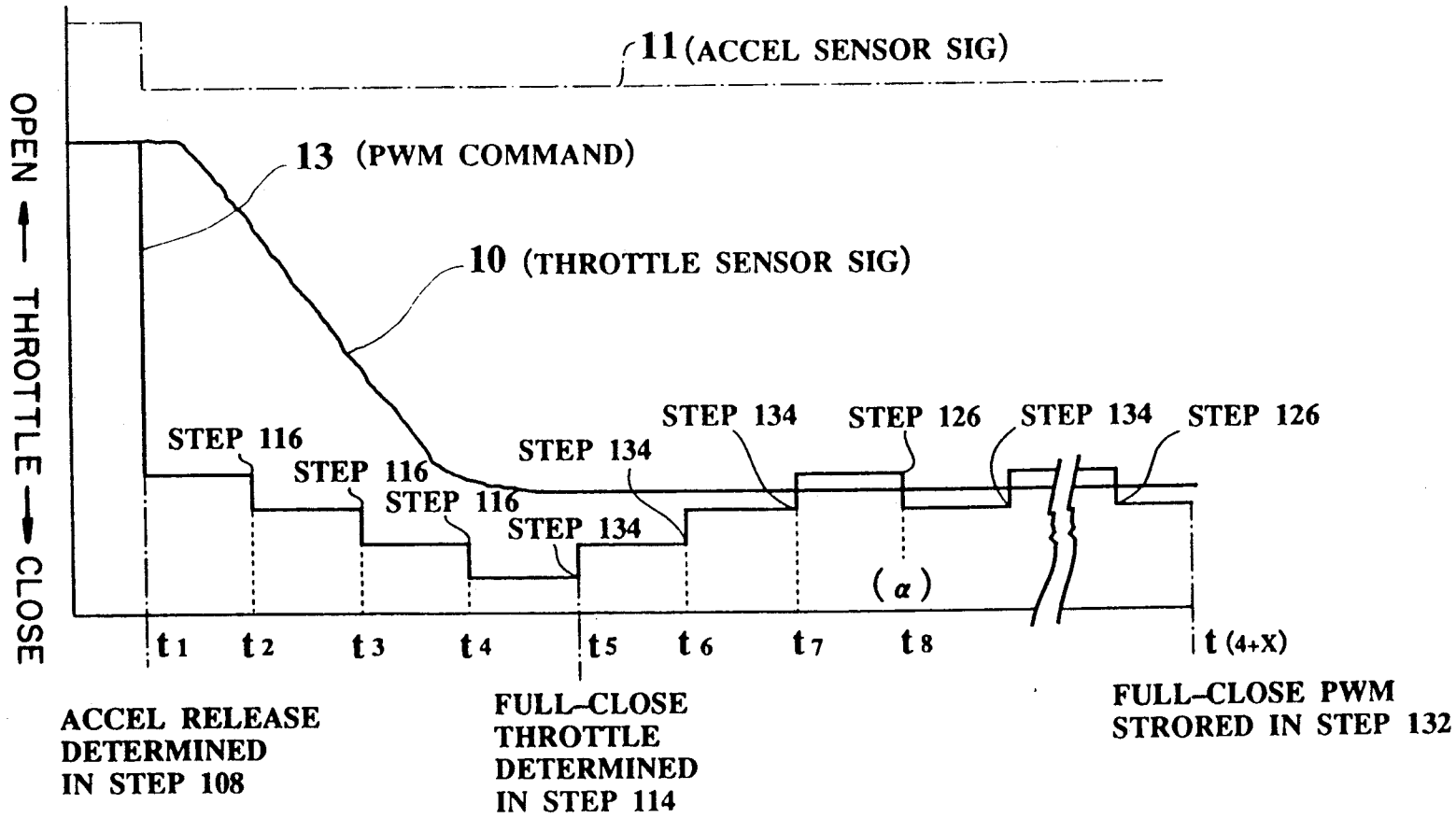
FIG. 4 is a timing chart for assistance in explaining the operation of the throttle opening-rate PWM command generator according to the present invention shown in FIG. 2A.

FIG. 4 shows a timing chart for assistance in explaining the operation for obtaining the throttle full-close PWM command signal 13. When the driver releases the accel pedal 1 at time point t1, since the voltage level of the accel sensor signal 11 drops, control determines that the accel is released (YES in step 108). At this time point t1, the throttle valve 7 is not yet full closed, so that the full-close PWM command 13 is kept outputted by repeating the processing executed in step 116 at the succeeding time points t2, t3, and t4. Thereafter, control determines that the throttle is full closed at time point t5 (YES in step 114). At this time, since the signal level of the PWM command signal 13 is offset in the throttle-close direction from the throttle sensor signal 10, the close-direction PWM command signal is outputted. Therefore, the motor direction monitor signal 12 is at H-level (YES in step 122), so that the PWM command signal 13 is switched to the open-direction command signal 13 (in step 134) after counter increment (in step 128). Since the motor direction monitor signal is at H-level (in the close direction) at time points t6 and t7, the processing executed tin step 134 is repeated to switch the PWM command signal 13 in the throttle-open direction.

However, at time point t8, since the pulse width of the PWM command signal 13 is larger in signal level than that of the throttle sensor signal 10, the PWM command signal 13 is switched in the close-direction (in step 126) after counter increment (in step 124). The above-mentioned processing after the time point t5 is repeated X times, and the full-close PWM command signal 13 obtained at time t4+X is stored as a basic full-close PWM command (in step 132).

As described above, in the throttle valve control method according to the present invention, the full-close throttle valve position obtained when the ignition switch is turned on is stored; the PWM throttle command signal is sampled at each control period; when the sampled signal level is smaller or higher than the stored sensor valve, the sampled signal valve is increased or decreased to the stored signal level; when the sampled signal level of the PWM throttle command matches that of the stored sensor valve, the sampled signal level is determined as the basic PWM command signal level corresponding to the full-closed throttle valve position. In other word, when there exists a difference in signal level between the sensor signal level stored when the throttle valve is full closed and that detected when the throttle valve is full closed, since the difference between the two is corrected before the PWM command signal is generated, it is possible to generate an accurate PWM command signal corresponding to the actual throttle opening rate, on the basis of the corrected basic full-close PWM command signal.

Therefore, it is, possible to eliminate error in throttle opening rate control due to dispersion of the throttle sensor characteristic, conversion characteristic from the PWM command signal to the analog command signal, etc., thus improving the throttle valve control precision according to the accel pedal stroke.

What is claimed:

1. A throttle valve control system for controlling a throttle valve (7) by an actuator (5) driven on the basis of PWM command signals (13) generated according to stroke of an accel pedal (1) and throttle signals (10) feed-backed by a throttle sensor (6), which comprises:

(a) throttle opening-rate command signal generator (3) including:

(1) storing means (31) for storing a signal level of the throttle sensor signal obtained when the throttle valve is full closed;

(2) detecting means (32) for detecting a signal level of the throttle sensor signal obtained when a full-close PWM command signal is applied to the actuator;

(3) correcting means (33) responsive to said storing means and said detecting means, for correcting the full-close PWM command signal so that the signal level of the throttle sensor signal stored in said storing means matches that detected by said detecting means; and (4) PWM command generating means (34) responsive to said correcting means, for generating PWM command signals on the basis of the corrected full-close PWM command signal; and (b) a throttle controller (4) responsive to said opening-rate command signal generator and the throttle sensor, for feed-back controlling throttle valve opening rate on the basis of the generated PWM command signals and the throttle sensor signals.

2. The throttle valve control system of claim 1, wherein said throttle controller (4) comprises:

(a) a convertor (41) for converting the PWM command signal into an analog command signal;

(b) a differential amplifier (42) responsive to said convertor and the throttle sensor, for generating a difference signal in voltage level between the analog command signal and the throttle sensor signal;

(c) a calculator (43) responsive to said differential amplifier, for calculating an actuator drive signal; and (d) an actuator driver (44) responsive to said calculator, for driving the actuator to actuate the throttle valve.

3. A method of controlling a throttle valve (7) by an actuator (5) driven in response to PWM command signals (13) generated according to stroke of an accel pedal (1), comprising the steps of:

(a) detecting and storing an accel sensor signal obtained when the accel pedal is released;

(b) detecting and storing a throttle sensor signal obtained when the throttle valve is full closed;

(c) when determining that the accel pedal is released but the throttle valve is not full closed on the basis of the stored accel and throttle sensor signals, decreasing pulse width of the PWM command signal until the throttle is full closed;

(d) when determining that the throttle valve is full closed, checking whether the actuator is driven in throttle-close direction or -open direction;

(e) when the actuator is driven in throttle close direction, increasing the PWM pulse width in a throttle-open direction;

(f) when the actuator is driven in throttle open direction, decreasing the PWM pulse width in a throttle-close direction;

(g) repeating the above steps (e) and (f) a predetermined number of times;

(h) storing the PWM pulse width as a full-close PWM command signal; and (i) controlling the throttle valve on the basis of the stored full-close PWM command signal and in response to the generated PWM command signals.

4. A method of controlling a throttle valve (7) by an actuator (5) driven in response to a PWM command signal (13) generated according to stroke of an accel pedal (1), comprising the steps of:

(a) storing an accel sensor signal when the accel pedal is released;

(b) storing a throttle sensor signal when the accel pedal is released;

(c) detecting a current accel sensor signal;

(d) comparing the current detected accel sensor signal with the stored accel-release sensor signal;

(e) if the current detected accel sensor signal is equal to or smaller in signal level than the stored accel sensor signal, detecting a current throttle sensor signal;

(f) comparing the current detected throttle sensor signal with the stored throttle sensor signal;

(g) if the current detected throttle sensor signal is higher is signal level than the stored throttle sensor signal, decreasing pulse width of the PWM command signal until the throttle valve is full closed;

(h) if the current detected throttle sensor signal is equal to or smaller in signal level than the stored throttle sensor signal, detecting whether the actuator is driven in throttle-close direction or in throttle-open direction;

(i) if the actuator is driven in the throttle-close direction, increment a counter;

(j) checking whether the incremented counter valve is equal to or larger than a predetermined valve;

(k) if the incremented counter valve is smaller than the predetermined valve, increasing the PWM pulse width in throttle-open direction;

(l) if the actuator is driven in the throttle-open direction in step (h) above, increment the counter;

(m) decreasing the PWM pulse width in throttle-close direction;

(n) repeating the above steps from (h) to (m);

(o) after the above steps are repeated by a predetermined number of times, storing the PWM pulse width as a full-close PWM command signal;

(p) generating PWM command signals on the basis of the stored full-close PWM command signal; and (q) controlling the throttle valve on the basis of the generated PWM command signals and returning to step (c) above.

5. The method of claim 4, which further comprises the steps of storing a new accel-release sensor signal when the current detected accel sensor signal is smaller in signal level than the stored accel sensor signal and storing a new throttle full-close sensor signal when the current detected throttle sensor signal is smaller in signal level than the stored throttle sensor signal.

6. The method of claim 4, which further comprises the steps of checking whether the system is normal or not and if not normal storing a previously determined reference full-close PWM command as the full-close PWM command.

* * * * *